US011608705B2

(12) United States Patent
Wang et al.

(10) Patent No.: US 11,608,705 B2
(45) Date of Patent: Mar. 21, 2023

(54) DISSOLVABLE FRAC PLUG ADAPTER, METHOD FOR MEASURING DYNAMIC DOWNHOLE TEMPERATURE, AND METHOD FOR FABRICATING DISSOLVABLE FRAC PLUG

(71) Applicant: CHENGDU INNOX TECHNOLOGY CO., LTD., Chengdu (CN)

(72) Inventors: Jinlu Wang, Chengdu (CN); Qijun Zeng, Chengdu (CN)

(73) Assignee: CHENGDU INNOX TECHNOLOGY CO., LTD., Chengdu (CN)

( * ) Notice: Subject to any disclaimer, the term of this patent is extended or adjusted under 35 U.S.C. 154(b) by 0 days.

(21) Appl. No.: 17/790,157

(22) PCT Filed: Feb. 19, 2020

(86) PCT No.: PCT/CN2020/075838

§ 371 (c)(1),
(2) Date: Jun. 30, 2022

(87) PCT Pub. No.: WO2021/159550

PCT Pub. Date: Aug. 19, 2021

(65) Prior Publication Data

US 2023/0034797 A1 Feb. 2, 2023

(30) Foreign Application Priority Data

Feb. 14, 2020 (CN) ..... 202010092875.4
Feb. 14, 2020 (CN) ..... 202020169989.X

(51) Int. Cl.
*E21B 33/134* (2006.01)
*E21B 47/07* (2012.01)
*E21B 33/12* (2006.01)

(52) U.S. Cl.
CPC ..... *E21B 33/134* (2013.01); *E21B 33/1204* (2013.01); *E21B 47/07* (2020.05)

(58) Field of Classification Search
CPC ..... E21B 33/134; E21B 47/07; E21B 33/12; E21B 2200/08
See application file for complete search history.

(56) References Cited

U.S. PATENT DOCUMENTS 11,371,313 B2 * 6/2022 Pang ..... E21B 33/1212
2005/0205264 A1 * 9/2005 Starr ..... E21B 33/134 166/243

(Continued)

FOREIGN PATENT DOCUMENTS

CA 2307972 C 9/2006
CA 2688704 A1 * 6/2011 ..... E21B 33/1204

(Continued)

*Primary Examiner* — Daniel P Stephenson
(74) *Attorney, Agent, or Firm* — Bayramoglu Law Offices LLC

(57) ABSTRACT

A dissolvable frac plug adapter includes an adapter body and a temperature acquisition and recording apparatus, where the temperature acquisition and recording apparatus is fixed in the adapter body. The adapter body is configured to connect a setting tool and a dissolvable frac plug. The temperature acquisition and recording apparatus is configured to acquire and record an ambient temperature at which the adapter body is located. A method for measuring a dynamic downhole temperature using the dissolvable frac plug adapter and a method for fabricating a dissolvable frac plug using the dissolvable frac plug adapter are provided to measure the dynamic downhole ambient temperature during pumping of the dissolvable frac plug, which features convenient operation and low cost, provides a basis for material selection and design of an ideal dissolvable frac plug for a region, and facilitates fabrication of the ideal dissolvable frac plug for the region.

16 Claims, 3 Drawing Sheets

(56) References Cited

U.S. PATENT DOCUMENTS

| | | | | |
|---|---|---|---|---|
| 2016/0108695 | A1* | 4/2016 | Okura | E21B 33/1208 166/135 |
| 2017/0335678 | A1* | 11/2017 | Ciezobka | E21B 47/07 |

FOREIGN PATENT DOCUMENTS

| | | | | | |
|---|---|---|---|---|---|
| CN | 106089148 | A | | 11/2016 | |
| CN | 108716379 | A | | 10/2018 | |
| CN | 110374549 | A | | 10/2019 | |
| CN | 210003249 | U | | 1/2020 | |
| CN | 111155984 | A | * | 5/2020 | E21B 33/134 |
| CN | 215927324 | U | * | 3/2022 | |
| CN | 217462140 | U | * | 9/2022 | |
| WO | 2011097091 | A3 | | 10/2011 | |
| WO | WO-2021159550 | A1 | * | 8/2021 | E21B 33/134 |

* cited by examiner

DISSOLVABLE FRAC PLUG ADAPTER, METHOD FOR MEASURING DYNAMIC DOWNHOLE TEMPERATURE, AND METHOD FOR FABRICATING DISSOLVABLE FRAC PLUG

CROSS REFERENCES TO THE RELATED APPLICATIONS

This application is a national phase of International Patent Application No. PCT/CN2020/075838 filed on Feb. 19, 2020, which claims priority based on Chinese patent application 202020169989.X filed on Feb. 14, 2020 and Chinese patent application 202010092875.4 filed on Feb. 14, 2020, the entire contents of which are incorporated herein by reference.

TECHNICAL FIELD

The present disclosure relates to the technical field of oil and gas exploitation, and in particular to a dissolvable frac plug adapter, a method for measuring a dynamic downhole temperature, and a method for fabricating a dissolvable frac plug.

BACKGROUND

In the field of oil and gas development, frac plugs are often used for multi-stage formation hydraulic fracturing reconstruction in the process of unconventional well completion. Multi-stage hydraulic fracturing for horizontal well is an important means for reservoir stimulation to effectively improve single-well production, and frac plugs are an important tool for multi-stage hydraulic fracturing.

Dissolvable frac plugs are used to temporarily seal the wellbore and are dissolvable in the well, which reduces or eliminates the need for drill out after the fracturing operation, thereby reducing the overall cost and operational risk. When in use, the dissolvable frac plug is connected with a tool string including a setting tool and a perforating gun string through an adapter, and a fluid is pumped and injected through a wellhead to send the tool string into the horizontal well. After the setting tool and the dissolvable frac plug connected through the adapter reach a preset setting position, the setting tool is activated to set the dissolvable frac plug, thereby sealing the wellbore. After the dissolvable frac plug is set, the adapter is disconnected from the dissolvable frac plug. The tool string including the adapter, the setting tool and the perforating gun string is lifted up, such that the perforating gun string reaches a designed perforating position for perforating. After the perforation is completed, the tool string including the adapter, the setting tool, and the perforating gun string is retrieved out of the wellhead from the wellbore through a cable connected with the back end of the tool string. After the tool string exits the well, fracturing balls are thrown into the wellbore through the wellhead for a first-stage fracturing. After the first-stage fracturing operation is completed, the above steps are repeated for the next-stage fracturing. After the multi-stage fracturing operation is completed, the downhole temperature rises, and the salinity of the fluid in the wellbore increases, causing the dissolvable frac plug to dissolve.

Dissolvability is an important indicator for evaluating the performance of dissolvable frac plugs. A desirable dissolvable frac plug must not dissolve during the period after the completion of setting before the completion of fracturing, which keeps the wellbore sealed. After the fracturing operation is completed, as the downhole temperature rises, the dissolvable frac plug must dissolve quickly and completely, which reduces the time of well drifting and ensure the effect of well drifting. The dissolution rate of dissolvable frac plug is related to the downhole ambient temperature. A higher downhole ambient temperature expedites dissolution of the dissolvable frac plug, and vice versa. It is crucial for the material selection and design of the dissolvable frac plug to accurately determine the dynamic ambient temperature of the dissolvable frac plug under the fluid condition at the setting position in the well.

When dissolvable frac plugs are sent to the downhole fluid environment, the pumping and fracturing operations for fluids pumped into the wellbore both affect the downhole ambient temperature. The prior art typically measures static downhole ambient temperature under the fluid-free condition, which is significantly different from the dynamic downhole ambient temperature under the fluid-containing condition. Therefore, the dissolvable frac plug designed based on the static downhole ambient temperature acquired under the fluid-free condition has unsatisfied dissolution performance and may have less than desirable sealing effect during the pumping and fracturing operations and have less than desirable dissolution efficiency after the completion of fracturing.

Currently, there is a method measuring the dynamic downhole ambient temperature under the fluid condition by a real-time downhole optical fiber detection technology. However, this method has high cost and complicated operation. The ambient temperature of the horizontal well at the same depth is not very different in the same region but varies greatly in different regions. In order to ensure the effective use of dissolvable frac plugs, the ideal dissolvable frac plugs for different regions need to be independently designed or selected. If the real-time downhole optical fiber detection technology is used, real-time optical fiber detection is needed for every region, which will greatly increase the cost and workload.

SUMMARY

The present disclosure aims to provide a dissolvable frac plug adapter, a method for measuring a dynamic downhole temperature, and a method for fabricating a dissolvable frac plug. The present disclosure can measure the dynamic downhole ambient temperature during pumping of the dissolvable frac plug, and features convenient operation and low cost. The present disclosure provides a basis for material selection and design of an ideal dissolvable frac plug for a horizontal well in a region, thus facilitating fabrication of the ideal dissolvable frac plug for the horizontal well in the region.

In order to achieve the above objectives, the present disclosure adopts the following technical solutions.

The present disclosure provides a dissolvable frac plug adapter. The dissolvable frac plug adapter includes an adapter body and a temperature acquisition and recording apparatus, where the temperature acquisition and recording apparatus is fixed in the adapter body. The adapter body is configured to connect a setting tool and a dissolvable frac plug. The temperature acquisition and recording apparatus is configured to acquire and record an ambient temperature at which the adapter body is located.

The present disclosure has the following beneficial effects. The adapter body is pumped downhole with the dissolvable frac plug, and is in the same downhole fluid environment as the dissolvable frac plug. The temperature acquisition and recording apparatus in the adapter body acquires and records the dynamic downhole ambient temperature during pumping of the dissolvable frac plug, and the dynamic downhole ambient temperature can be accessed after the adapter body is retrieved. The present disclosure features convenient operation and low cost and provides a basis for material selection and design of an ideal dissolvable frac plug required by the horizontal well in the region, facilitating fabrication of the ideal dissolvable frac plug for the horizontal well in the region.

Further, the dissolvable frac plug adapter may include a mounting pin. The adapter body may be provided with a first mounting hole matched with the mounting pin. The mounting pin may be inserted into the first mounting hole and may be detachably connected with the adapter body. An end of the mounting pin may be provided with a second mounting hole, which is a blind hole. An opening of the second mounting hole may be provided with a cap plug matched with the opening. The cap plug may be detachably connected with the second mounting hole. The temperature acquisition and recording apparatus may be provided in the second mounting hole.

The above further solution has the following beneficial effects. The temperature acquisition and recording apparatus is provided in the mounting pin. Since the mounting pin is provided in the adapter body, the adapter body can protect the temperature acquisition and recording apparatus and avoid damage to the temperature acquisition and recording apparatus during pumping and retrieval. In addition, the temperature acquisition and recording apparatus is easy to mount and dismount.

Further, an outer wall of the mounting pin may be provided with an external thread, and an inner wall of the first mounting hole may be provided with an internal thread matched with the external thread. The mounting pin may be screwed with the adapter body through the first mounting hole.

The above further solution has the following beneficial effect. The mounting pin and the first mounting hole are easy to mount and dismount.

Further, the end of the mounting pin may be provided with a joint for driving the mounting pin to rotate. Two ends of the mounting pin and the joint may be all located in the first mounting hole.

The above further solution has the following beneficial effect. The mounting pin has high reliability. It is integrally located in the first mounting hole to avoid damage to the wellbore, the mounting pin, and the temperature acquisition and recording apparatus during pumping and retrieval.

Further, the mounting pin and the cap plug may be made of a thermally conductive material. The above further solution has the following beneficial effect. The materials of the mounting pin and the cap plug are facilitates the temperature acquisition and recording apparatus in the mounting pin to measure the ambient temperature.

Further, the adapter body may be columnar.

The above further solution has the following beneficial effect. The adapter body easily moves in the wellbore with little resistance.

Further, the adapter body may be hollow and penetrates through a front end to a back end. The front end of the adapter body may be connected with the dissolvable frac plug, and the back end of the adapter body may be connected with the setting tool.

The above further solution has the following beneficial effects. The adapter body is designed to be light weight so fluid can flow through the inner cavity of the adapter body and resistance is reduced.

Further, the temperature acquisition and recording apparatus may be provided in the inner cavity of the adapter body.

The above further solution has the following beneficial effects. The temperature acquisition and recording apparatus does not protrude out of the adapter body, thus avoiding damage caused by collision. In addition, the temperature acquisition and recording apparatus can be fully contacted with the fluid environment, which facilitates the measurement of the dynamic ambient temperature.

The present disclosure provides a method for measuring a dynamic downhole temperature, including the following steps:

mounting of a temperature acquisition and recording apparatus: mounting the temperature acquisition and recording apparatus in an adapter body; and connecting a setting tool with a dissolvable frac plug through the adapter body;

first pumping: putting the dissolvable frac plug connected with the adapter body and the setting tool into a wellbore after the step of mounting the temperature acquisition and recording apparatus is completed; and injecting a pumping fluid into the wellbore through a wellhead to pump the dissolvable frac plug to a first setting position;

first setting: setting after the dissolvable frac plug reaches the first setting position;

first temperature acquisition and recording: acquiring and recording, by the temperature acquisition and recording apparatus, a dynamic ambient temperature in the steps of first pumping and first setting;

first exiting: disconnecting the adapter body from the dissolvable frac plug after the step of first setting is completed; retrieving the adapter body and the setting tool out of the wellhead through the wellbore; and accessing the dynamic ambient temperature acquired and recorded by the temperature acquisition and recording apparatus in the adapter body in the step of first temperature acquisition and recording; and first fracturing: injecting a fracturing fluid into the wellbore through the wellhead after the step of first exiting is completed.

The present disclosure has the following beneficial effects. The temperature acquisition and recording apparatus in the adapter body measures the dynamic downhole ambient temperature during pumping of the dissolvable frac plug during the multi-stage hydraulic fracturing process. The present disclosure avoids other redundant operations, is easy and convenient to use, and is low cost. Since the temperature acquisition and recording apparatus is in the same fluid environment as the dissolvable frac plug, the acquired measurement data is accurate. The present disclosure provides a basis for material selection and design of the ideal dissolvable frac plug for the horizontal well in the region, facilitating fabrication of the ideal dissolvable frac plug for the horizontal well in the region.

Further, in the step of first fracturing, the fracturing fluid may have a flow rate greater than a flow rate of the pumping fluid in the step of first pumping. The total volume of the fracturing fluid injected into the wellbore may be greater than the total volume of the pumping fluid injected into the wellbore in the step of first pumping.

The above further solution has the following beneficial effects. The flow rate of the fracturing fluid is greater than the flow rate of the pumping fluid in the step of first pumping. The total amount of the fracturing fluid injected into the wellbore is greater than the total amount of the pumping fluid injected into the wellbore in the step of first pumping. The dynamic ambient temperature in the wellbore during pumping is greater than or equal to the dynamic ambient temperature in the wellbore during fracturing. Therefore, it is only necessary to access the dynamic ambient temperature during pumping. The dissolving temperature of the dissolvable frac plug designed by the present disclosure is greater than the maximum dynamic ambient temperature during pumping. This design ensures that the dissolvable frac plug does not dissolve until the fracturing is completed, thereby sealing the wellbore at the first setting position before the fracturing is completed.

Further, the method for measuring a dynamic downhole temperature may further include the following steps:

second pumping: putting the adapter body with the temperature acquisition and recording apparatus into the wellbore after the step of first fracturing is completed; and injecting the pumping fluid into the wellbore through the wellhead to pump the adapter body downhole;

second temperature acquisition and recording: acquiring and recording, by the temperature acquisition and recording apparatus, the dynamic ambient temperature in the step of second pumping; and second exiting: retrieving the adapter body out of the wellhead through the wellbore after the step of second temperature acquisition and recording is completed; and accessing the dynamic ambient temperature acquired and recorded by the temperature acquisition and recording apparatus in the adapter body in the step of second temperature acquisition and recording.

The above further solution has the following beneficial effects. Through the step of second temperature acquisition and recording, the dynamic ambient temperature in the horizontal well after completion of the fracturing of the previous stage can be acquired, which provides a basis for designing the dissolving temperature of the dissolvable frac plug.

Further, in the step of second pumping, the adapter body may be connected with the setting tool and the dissolvable frac plug, and the pumping fluid may pump the dissolvable frac plug connected with the adapter body and the setting tool to a second setting position.

The method for measuring a dynamic downhole temperature further includes the following steps:

second setting: pumping the dissolvable frac plug to the second setting position after the step of second pumping is completed, and setting the dissolvable frac plug at the second setting position;

where, after the step of second setting is completed, the dissolvable frac plug is disconnected from the adapter body, and then the step of second exiting begins; and the setting tool and the adapter body are retrieved out of the wellhead through the wellbore; and second fracturing: injecting the fracturing fluid into the wellbore through the wellhead after the step of second exiting is completed.

The above further solution has the following beneficial effects. The step of second temperature acquisition and recording is performed in the fracturing of the following stage after the fracturing of the previous stage. It does not need other redundant operations, has low cost and simple operation, and avoids increased workload.

The present disclosure provides a method for fabricating a dissolvable frac plug, which designs the dissolvable frac plug based on a dynamic ambient temperature measured by the method for measuring a dynamic downhole temperature.

The present disclosure has the following beneficial effect. The dissolvable frac plug designed by the present disclosure has desired downhole dissolving performance.

Further, in the design of the dissolvable frac plug, a dissolving temperature of the dissolvable frac plug is greater than a maximum dynamic ambient temperature acquired and recorded in the step of first temperature acquisition and recording.

The above further solution has the following beneficial effect. The dissolvable frac plug does not dissolve prematurely until the fracturing is completed, thus ensuring the fracturing effect.

Figure 1:
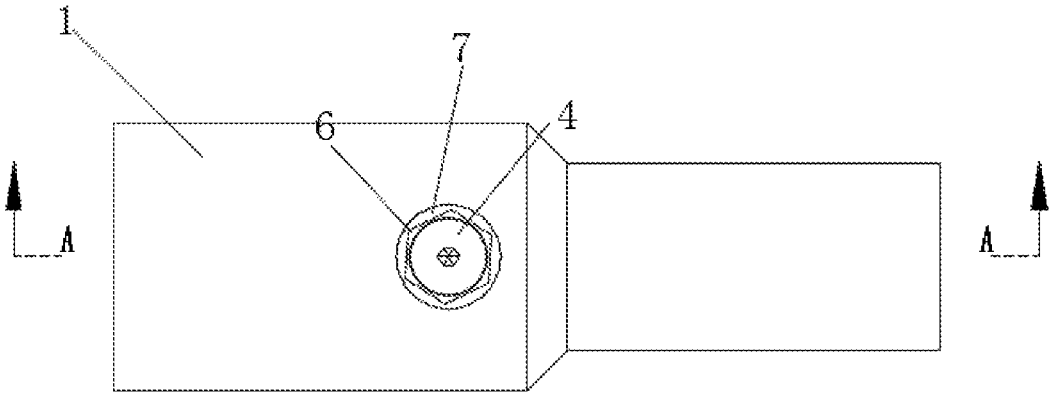
FIG. 1 is a first schematic view of a dissolvable frac plug adapter according to an embodiment of the present disclosure.

Reference Numerals: 1. adapter body; 2. mounting pin; 3. temperature acquisition and recording apparatus; 4. cap plug; 5. second mounting hole; 6. joint; 7. first mounting hole; 8. wellhead; 9. wellbore; 10. first setting position; and 11. second setting position.

DETAILED DESCRIPTION OF THE EMBODIMENTS

To make the objectives, technical solutions, and advantages of the present disclosure clearer, the following describes the present disclosure in more detail with reference to the drawings.

Figure 2:
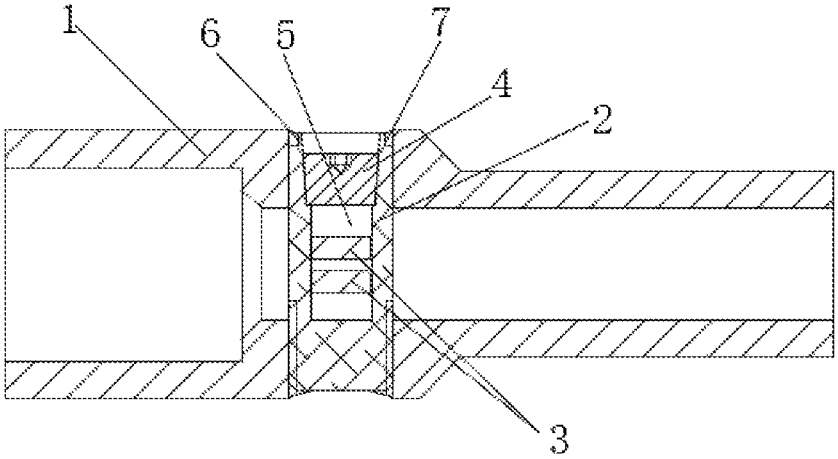
FIG. 2 is an A-A view.
Figure 3:
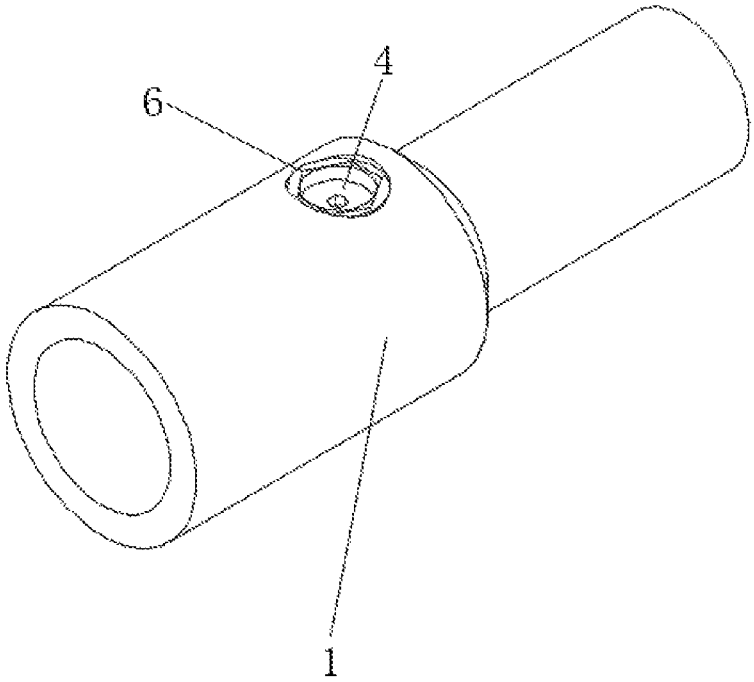
FIG. 3 is a second schematic view of the dissolvable frac plug adapter according to an embodiment of the present disclosure.
Figure 4:
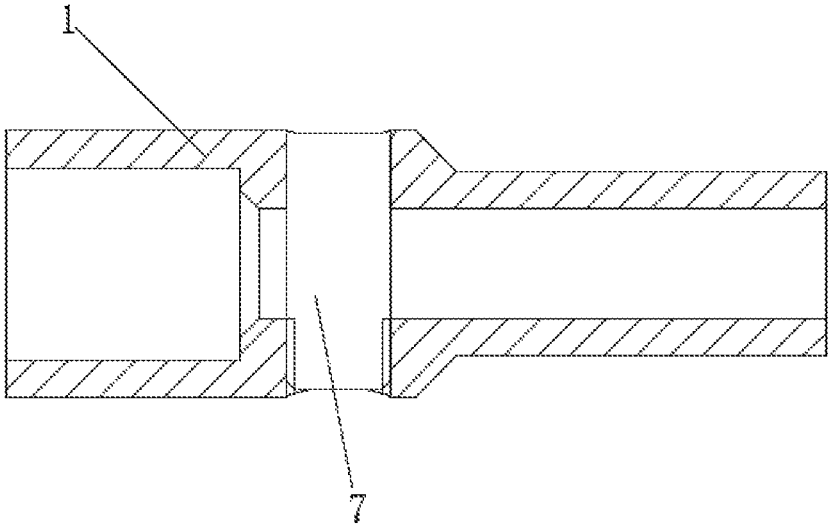
FIG. 4 is a schematic view of an adapter body according to an embodiment of the present disclosure.
Figure 5:
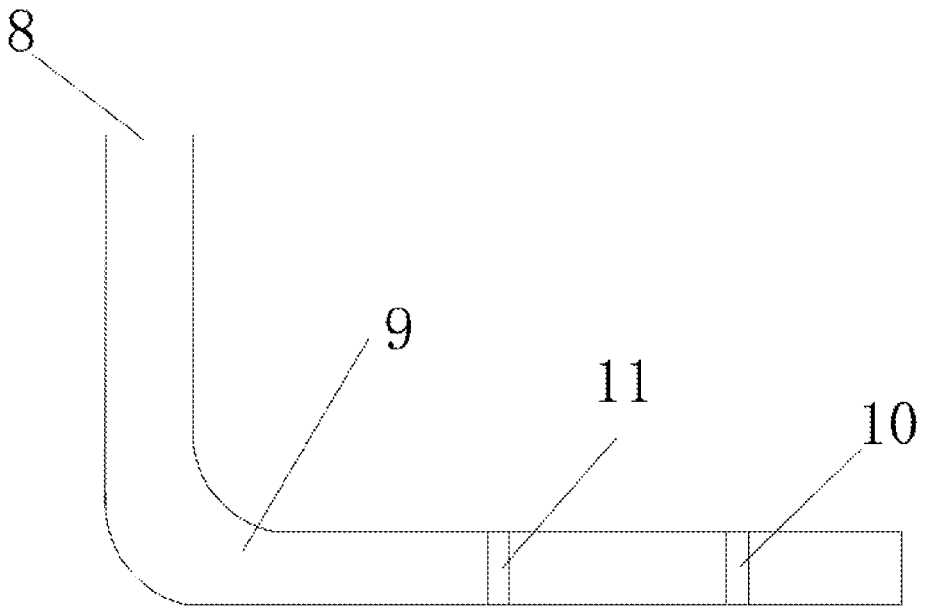
FIG. 5 is a schematic view of a horizontal well according to an embodiment of the present disclosure.

As shown in FIGS. 1 to 5, an embodiment of the present disclosure provides a dissolvable frac plug adapter. The dissolvable frac plug adapter includes an adapter body 1 and a temperature acquisition and recording apparatus 3. The temperature acquisition and recording apparatus 3 is fixed in the adapter body 1. The adapter body 1 is configured to connect a setting tool and a dissolvable frac plug. The temperature acquisition and recording apparatus 3 is configured to acquire and record an ambient temperature at which the adapter body 1 is located. The temperature acquisition and recording apparatus 3 may be an existing miniature temperature acquisition and recording apparatus 3.

As a further solution of the embodiment of the dissolvable frac plug adapter, the adapter body 1 is columnar, preferably cylindrical. The adapter body 1 is provided with a front thin portion and a back thick portion, which are connected by a circular surface. The adapter body 1 is hollow and penetrates through the front thin portion and the back thick portion. The adapter body 1 is provided with a cylindrical inner cavity that is coaxial with the adapter body 1. The adapter body 1 has a front end connected with the dissolvable frac plug and a back end connected with the setting tool.

As a further solution of the embodiment of the dissolvable frac plug adapter, the dissolvable frac plug adapter further includes a mounting pin 2. The adapter body 1 is provided with a first mounting hole 7 matched with the mounting pin 2. The first mounting hole 7 is located at the thick portion of the adapter body 1. The first mounting hole 7 penetrates through two opposite sides of the adapter body 1 along a radial direction of the adapter body 1. The mounting pin 2 is inserted into the first mounting hole 7 and is detachably connected with the adapter body 1. An end of the mounting pin 2 is provided with a second mounting hole 5. The second mounting hole 5 is a blind hole. An opening of the second mounting hole 5 is provided with a cap plug 4 matched with the opening, and the cap plug 4 is detachably connected with the second mounting hole 5. The temperature acquisition and recording apparatus 3 is provided in the second mounting hole 5. The mounting pin 2 and the cap plug 4 are made of a thermally conductive material.

As a further solution of the embodiment of the dissolvable frac plug adapter, an outer wall of the mounting pin 2 is provided with an external thread, and an inner wall of the first mounting hole 7 is provided with an internal thread matched with the external thread. The mounting pin 2 is screwed with the adapter body 1 through the first mounting hole 7.

As a further solution of the embodiment of the dissolvable frac plug adapter, the end of the mounting pin 2 is provided with a joint 6 for driving the mounting pin 2 to rotate. Two ends of the mounting pin 2 and the joint 6 are all located in the first mounting hole 7. The external thread and the joint 6 are respectively provided at the two ends of the mounting pin 2. The internal thread is located on one side wall of the adapter body 1. The joint 6 may be an external hexagonal joint 6, and the mounting pin 2 may be rotated by a tool such as a socket wrench. The cap plug 4 is a cap plug 4 with a national pipe thread (NPT).

As a further solution of the embodiment of the dissolvable frac plug adapter, the mounting pin 2 penetrates through the inner cavity of the adapter body 1. The temperature acquisition and recording apparatus 3 is provided in the inner cavity of the adapter body 1.

An embodiment of the present disclosure provides a method for measuring a dynamic downhole temperature, including the following steps:

Mounting of a temperature acquisition and recording apparatus 3: Set, through computer software, a time and frequency of the temperature acquisition and recording apparatus 3 for acquisition and recording; mount the temperature acquisition and recording apparatus 3 in the adapter body 1; and connect a setting tool with a dissolvable frac plug through the adapter body 1.

First pumping: Put the dissolvable frac plug connected with the adapter body 1 and the setting tool into a wellbore 9 after the step of mounting the temperature acquisition and recording apparatus 3 is completed; and inject a pumping fluid into the wellbore 9 through a wellhead 8 to pump the dissolvable frac plug to a first setting position 10.

First setting: Set after the dissolvable frac plug reaches the first setting position 10.

First temperature acquisition and recording: acquire and record, by the temperature acquisition and recording apparatus, a dynamic ambient temperature 3 in the steps of first pumping and first setting.

First exiting: Disconnect the adapter body 1 from the dissolvable frac plug after the step of first setting is completed; retrieve the adapter body 1 and the setting tool out of the wellhead through the wellbore 9; and connect the temperature acquisition and recording apparatus 3 in the adapter body 1 with a computer to access the dynamic ambient temperature acquired and recorded in the step of first temperature acquisition and recording on the ground, where a minimum temperature for the dissolvable frac plug to dissolve in a region is greater than a maximum dynamic ambient temperature acquired and recorded in the step of first temperature acquisition and recording.

In the step of first exiting, the temperature acquisition and recording apparatus 3 may also acquire and record the dynamic ambient temperature.

The method for measuring a dynamic downhole temperature further includes: first fracturing: inject a fracturing fluid into the wellbore 9 through the wellhead 8 after the step of first exiting is completed.

In the step of first fracturing, the fracturing fluid has a flow rate greater than a flow rate of the pumping fluid in the step of first pumping, and the fracturing fluid injected into the wellbore 9 has a total amount greater than a total amount of the pumping fluid injected into the wellbore 9 in the step of first pumping. In a horizontal well at the same depth, the dynamic ambient temperature is related to the total amount and flow rate of the fluid in the wellbore 9. The dynamic ambient temperature in the wellbore 9 in the step of first fracturing is lower than or equal to the dynamic ambient temperature in the step of first pumping, which ensures that the dissolvable frac plug does not dissolve during pumping and fracturing.

The method for measuring a dynamic downhole temperature further includes the following steps:

Second pumping: Put the adapter body 1 with the temperature acquisition and recording apparatus 3 into the wellbore 9 after the step of first fracturing is completed; and inject the pumping fluid into the wellbore 9 through the wellhead 8 to pump the adapter body 1 downhole.

Second temperature acquisition and recording: Acquire and record, by the temperature acquisition and recording apparatus 3, a dynamic ambient temperature in the step of second pumping, where the dynamic ambient temperature is one in the horizontal well after the fracturing of a previous stage is completed.

Second exiting: Retrieve the adapter body 1 out of the wellhead through the wellbore 9 after the step of second temperature acquisition and recording is completed; and access the dynamic ambient temperature acquired and recorded by the temperature acquisition and recording apparatus 3 in the adapter body 1 in the step of second temperature acquisition and recording.

In the step of second pumping, the adapter body 1 is connected with the setting tool and the dissolvable frac plug, and the pumping fluid pumps the dissolvable frac plug connected with the adapter body 1 and the setting tool to a second setting position 11.

The method for measuring a dynamic downhole temperature further includes the following steps:

Second setting: Pump the dissolvable frac plug to the second setting position 11 after the step of second pumping is completed, and set the dissolvable frac plug at the second setting position 11, where the second setting position 11 is behind the first setting position 10.

After the step of second setting is completed, the dissolvable frac plug is disconnected from the adapter body 1, and then the step of second exiting begins; and the setting tool and the adapter body 1 are retrieved out of the wellhead through the wellbore 9.

Second fracturing: Inject the fracturing fluid into the wellbore 9 through the wellhead 8 after the step of second exiting is completed.

The temperature acquisition and recording apparatus 3 in the wellbore 9 may acquire and record the dynamic ambient temperature in each of the steps.

In the embodiment of the method for measuring a dynamic downhole temperature, in the multi-stage hydraulic fracturing process, the dynamic ambient temperature of a stage of the horizontal well during pumping is acquired through the pumping step of the previous stage. The dynamic ambient temperature of the previous stage after completion of the fracturing is acquired through the pumping step of the following stage. The dissolvable frac plug is designed based on the two dynamic ambient temperatures, which ensures that the dissolvable frac plug does not dissolve prematurely before the fracturing is completed. In the horizontal well, the depth is the same everywhere and the dynamic temperature is similar everywhere. Therefore, composite data can be acquired by repeating the measurement multiple times, so as to design the dissolvable frac plug for the horizontal well in the region.

An embodiment of the present disclosure provides a method for fabricating a dissolvable frac plug, which designs the dissolvable frac plug based on a dynamic ambient temperature measured by the method for measuring a dynamic downhole temperature.

In the design of the dissolvable frac plug, a dissolving temperature of the dissolvable frac plug is greater than a maximum dynamic ambient temperature acquired and recorded in the step of first temperature acquisition and recording. The dissolvable frac plug is designed based on the dynamic ambient temperature acquired and recorded in the step of second temperature acquisition and recording, and it can be quickly and fully dissolved.

Certainly, the present disclosure may further include other various embodiments. Those skilled in the art may make various modifications and variations to the present disclosure without departing from the spirit and essence of the present disclosure, but these modifications and variations should all fall within the protection scope defined by the appended claims of the present disclosure.

What is claimed is:

1. A dissolvable frac plug adapter, comprising an adapter body and a temperature acquisition and recording apparatus, wherein the temperature acquisition and recording apparatus is fixed in the adapter body; the adapter body is configured to connect a setting tool and a dissolvable frac plug; and the temperature acquisition and recording apparatus is configured to acquire and record an ambient temperature at a position where the adapter body is located.

2. The dissolvable frac plug adapter according to claim 1, wherein the dissolvable frac plug adapter further comprises a mounting pin; the adapter body is provided with a first mounting hole matched with the mounting pin; the mounting pin is inserted into the first mounting hole and is detachably connected with the adapter body; an end of the mounting pin is provided with a second mounting hole, the second mounting hole is a blind hole; an opening of the second mounting hole is provided with a cap plug matched with the opening; the cap plug is detachably connected with the second mounting hole; and the temperature acquisition and recording apparatus is provided in the second mounting hole.

3. The dissolvable frac plug adapter according to claim 2, wherein the mounting pin and the cap plug are made of a thermally conductive material.

4. The dissolvable frac plug adapter according to claim 1, wherein the adapter body is columnar.

5. A method for measuring a dynamic downhole temperature, comprising the following steps:

mounting of a temperature acquisition and recording apparatus: mounting the temperature acquisition and recording apparatus in an adapter body; and connecting a setting tool with a dissolvable frac plug through the adapter body;

first pumping: putting the dissolvable frac plug connected with the adapter body and the setting tool into a wellbore after the step of mounting the temperature acquisition and recording apparatus is completed; and injecting a pumping fluid into the wellbore through a wellhead to pump the dissolvable frac plug to a first setting position;

first setting: setting after the dissolvable frac plug reaches the first setting position;

first temperature acquisition and recording: acquiring and recording, by the temperature acquisition and recording apparatus, a dynamic ambient temperature in the steps of first pumping and first setting;

first exiting: disconnecting the adapter body from the dissolvable frac plug after the step of first setting is completed; retrieving the adapter body and the setting tool out of the wellhead through the wellbore; and accessing the dynamic ambient temperature acquired and recorded by the temperature acquisition and recording apparatus in the adapter body in the step of first temperature acquisition and recording; and first fracturing: injecting a fracturing fluid into the wellbore through the wellhead after the step of first exiting is completed.

6. The method for measuring a dynamic downhole temperature according to claim 5, wherein in the step of first fracturing, a flow rate of the fracturing fluid is greater than a flow rate of the pumping fluid in the step of first pumping, and a total amount of the fracturing fluid injected into the wellbore is greater than a total amount of the pumping fluid injected into the wellbore in the step of first pumping.

7. The method for measuring a dynamic downhole temperature according to claim 5, wherein the method further comprises the following steps:

second pumping: putting the adapter body with the temperature acquisition and recording apparatus into the wellbore after the step of first fracturing is completed; and injecting the pumping fluid into the wellbore through the wellhead to pump the adapter body downhole;

second temperature acquisition and recording: acquiring and recording, by the temperature acquisition and recording apparatus, a dynamic ambient temperature in the step of second pumping; and second exiting: retrieving the adapter body out of the wellhead through the wellbore after the step of second temperature acquisition and recording is completed; and accessing the dynamic ambient temperature acquired and recorded by the temperature acquisition and recording apparatus in the adapter body in the step of second temperature acquisition and recording.

8. The method for measuring a dynamic downhole temperature according to claim 7, wherein in the step of second pumping, the adapter body is connected with the setting tool and the dissolvable frac plug, and the pumping fluid pumps the dissolvable frac plug connected with the adapter body and the setting tool to a second setting position; and the method further comprises the following steps:

second setting: pumping the dissolvable frac plug to the second setting position after the step of second pumping is completed, and setting the dissolvable frac plug at the second setting position;

wherein, after the step of second setting is completed, the dissolvable frac plug is disconnected from the adapter body, and then the step of second exiting begins; and the setting tool and the adapter body are retrieved out of the wellhead through the wellbore; and second fracturing: injecting the fracturing fluid into the wellbore through the wellhead after the step of second exiting is completed.

9. A method for fabricating a dissolvable frac plug, comprising: designing the dissolvable frac plug based on a dynamic ambient temperature measured by the method for measuring a dynamic downhole temperature according to claim 5.

10. The method for fabricating a dissolvable frac plug according to claim 9, wherein in a design process of the dissolvable frac plug, a dissolving temperature of the dissolvable frac plug is greater than a maximum dynamic ambient temperature acquired and recorded in the step of first temperature acquisition and recording.

11. The method for fabricating a dissolvable frac plug according to claim 9, wherein in the method for measuring a dynamic downhole temperature, in the step of first fracturing, the fracturing fluid has a flow rate greater than a flow rate of the pumping fluid in the step of first pumping, and a total amount of the fracturing fluid injected into the wellbore is greater than a total amount of the pumping fluid injected into the wellbore in the step of first pumping.

12. The method for fabricating a dissolvable frac plug according to claim 11, wherein in a design process of the dissolvable frac plug, a dissolving temperature of the dissolvable frac plug is greater than a maximum dynamic ambient temperature acquired and recorded in the step of first temperature acquisition and recording.

13. The method for fabricating a dissolvable frac plug according to claim 9, wherein the method for measuring the dynamic downhole temperature further comprises the following steps:

second pumping: putting the adapter body with the temperature acquisition and recording apparatus into the wellbore after the step of first fracturing is completed; and injecting the pumping fluid into the wellbore through the wellhead to pump the adapter body downhole;

second temperature acquisition and recording: acquiring and recording, by the temperature acquisition and recording apparatus, a dynamic ambient temperature in the step of second pumping; and second exiting: retrieving the adapter body out of the wellhead through the wellbore after the step of second temperature acquisition and recording is completed; and accessing the dynamic ambient temperature acquired and recorded by the temperature acquisition and recording apparatus in the adapter body in the step of second temperature acquisition and recording.

14. The method for fabricating a dissolvable frac plug according to claim 13, wherein in a design process of the dissolvable frac plug, a dissolving temperature of the dissolvable frac plug is greater than a maximum dynamic ambient temperature acquired and recorded in the step of first temperature acquisition and recording.

15. The method for fabricating a dissolvable frac plug according to claim 9, wherein in the method for measuring a dynamic downhole temperature, in the step of second pumping, the adapter body is connected with the setting tool and the dissolvable frac plug, and the pumping fluid pumps the dissolvable frac plug connected with the adapter body and the setting tool to a second setting position; and the method further comprises the following steps:

second setting: pumping the dissolvable frac plug to the second setting position after the step of second pumping is completed, and setting the dissolvable frac plug at the second setting position;

wherein, after the step of second setting is completed, the dissolvable frac plug is disconnected from the adapter body, and then the step of second exiting begins; and the setting tool and the adapter body are retrieved out of the wellhead through the wellbore; and second fracturing: injecting the fracturing fluid into the wellbore through the wellhead after the step of second exiting is completed.

16. The method for fabricating a dissolvable frac plug according to claim 15, wherein in a design process of the dissolvable frac plug, a dissolving temperature of the dissolvable frac plug is greater than a maximum dynamic ambient temperature acquired and recorded in the step of first temperature acquisition and recording.

* * * * *